US007377802B2

(12) United States Patent
Allen

(10) Patent No.: US 7,377,802 B2
(45) Date of Patent: May 27, 2008

(54) PLUG AND CORD CONNECTOR SET WITH INTEGRATED CIRCUITRY

(75) Inventor: David Allen, Yardley, PA (US)

(73) Assignee: Fiber Optic Designs, Inc., Yardley, PA (US)

( * ) Notice: Subject to any disclaimer, the term of this patent is extended or adjusted under 35 U.S.C. 154(b) by 0 days.

(21) Appl. No.: 11/443,844

(22) Filed: May 26, 2006

(65) Prior Publication Data

US 2006/0270250 A1 Nov. 30, 2006

Related U.S. Application Data

(60) Provisional application No. 60/684,561, filed on May 26, 2005.

(51) Int. Cl.
*H01R 3/00* (2006.01)

(52) U.S. Cl. ..... 439/490; 439/76.1; 362/249; 362/641

(58) Field of Classification Search ..... 439/76.1, 439/43, 490; 362/249, 641, 255
See application file for complete search history.

(56) References Cited

U.S. PATENT DOCUMENTS

| | | | | |
|---|---|---|---|---|
| 6,290,533 | B1 * | 9/2001 | Major | 439/490 |
| 6,461,019 | B1 * | 10/2002 | Allen | 362/249 |
| 6,972,528 | B2 | 12/2005 | Allen | |
| 2006/0237439 | A1 * | 10/2006 | Norwood et al. | 219/506 |

* cited by examiner

*Primary Examiner*—Michael C. Zarroli
(74) *Attorney, Agent, or Firm*—Berenato, White & Stavish

(57) ABSTRACT

A plug and/or a plug and cord connector set that includes integrated circuitry for use with decorative lighting products such as Christmas lights and rope lights. The integrated circuitry included in the plug and/or plug and cord connector combination can serve to reduce or limit current, provide full-wave AC to DC rectification, provide overload protection, reduce voltage, protect against voltage spikes, add blinking or flashing functions, or any combination thereof. An optional intermediate circuit is included for the manufacture of light strings employing multiple series connections.

13 Claims, 12 Drawing Sheets

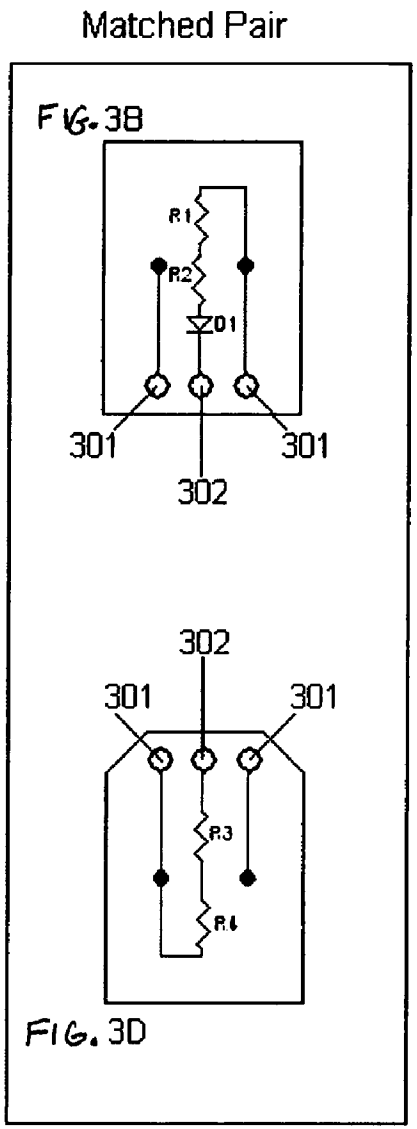
Matched Pair
FIG. 3B
R1
R2
D1
301
302
301
302
301
R3
R4
FIG. 3D
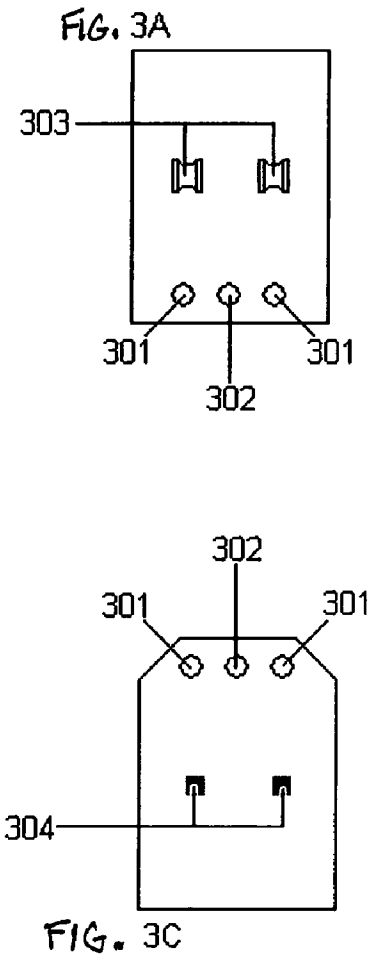
FIG. 3A
303
301
302
301
301
302
301
304
FIG. 3C Matched Pair 1
Matched Pair 2
Matched Pair 3

401
402 (+)
402 (-)
403
404
D1
D2
D3
D4
R1
R2
R3
C

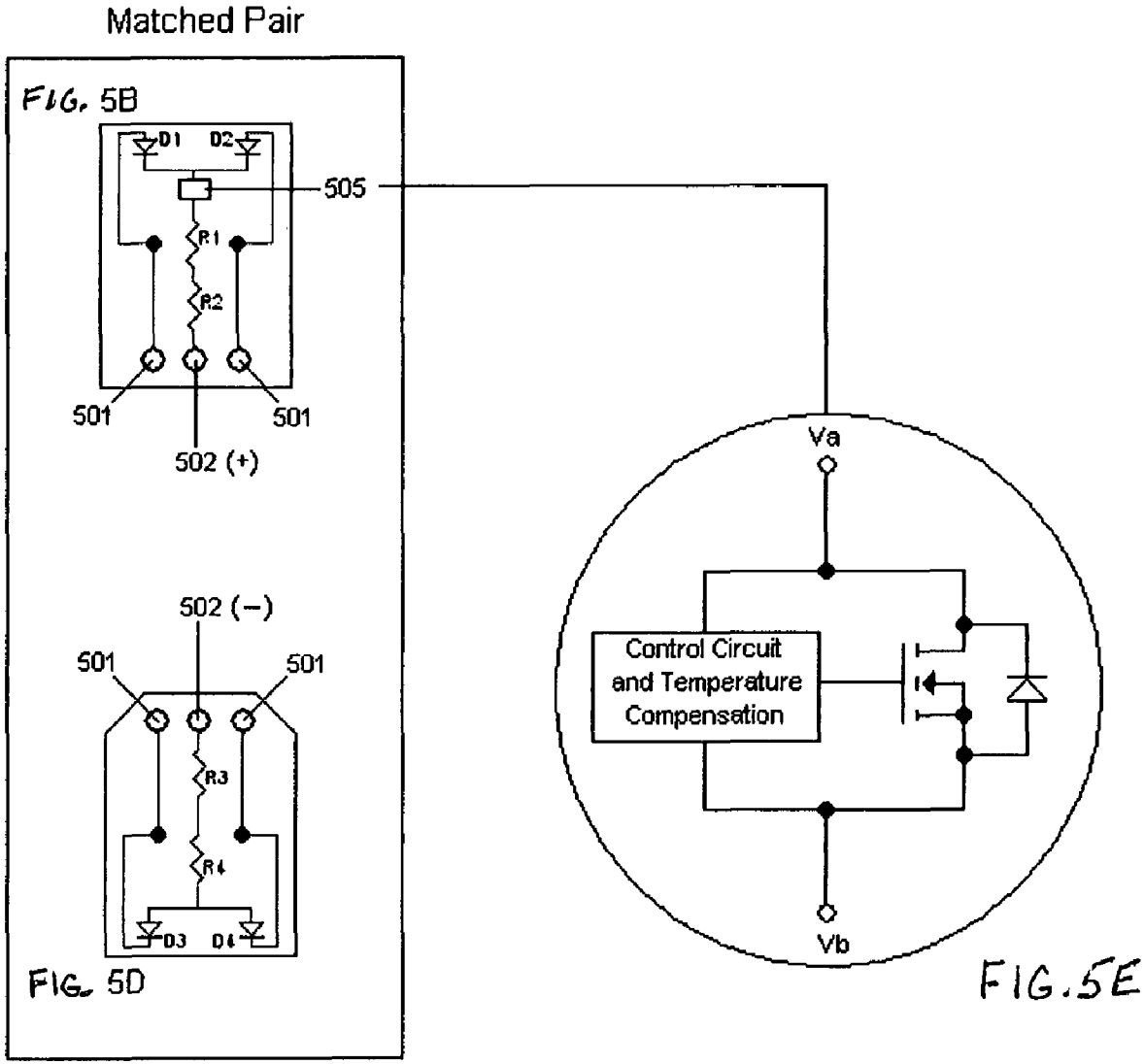
Matched Pair
FIG. 5B
505
D1
D2
R1
R2
501
502 (+)
501
502 (−)
501
R3
R4
D3
D4
501
FIG. 5D
Va
Vb
Control Circuit
and Temperature
Compensation
FIG. 5E
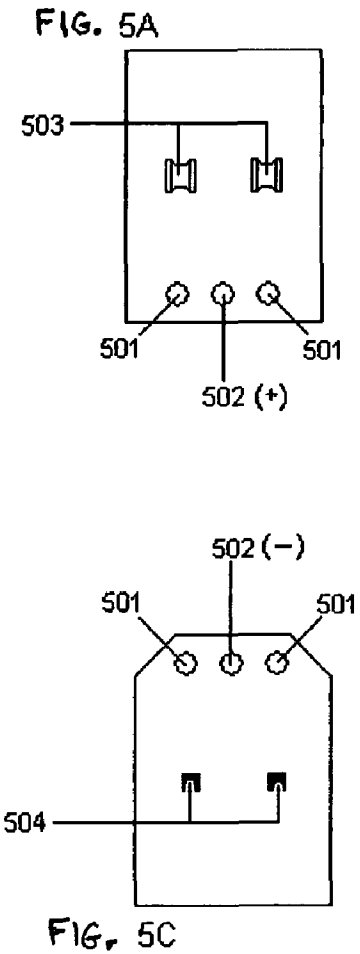
FIG. 5A
503
501
502 (+)
501
502 (−)
501
501
504
FIG. 5C Matched Pair 603
601
602
601

605
R1
R2
601
602
601

601
602
601
604

601
602
R3
R4
601

Va
Vb
Control Circuit
and Temperature
Compensation

PLUG AND CORD CONNECTOR SET WITH INTEGRATED CIRCUITRY

This application is a U.S. Non Provisional Patent Application which claims the benefit of U.S. Provisional Patent Application No. 60/684,561 filed May 26, 2005 and is hereby incorporated by reference in it's entirety.

BACKGROUND OF THE INVENTION

1. Field of Invention

The present invention relates to an improved plug, and/or plug and cord connector combination commonly used in the manufacture of decorative lighting products such as Christmas lights and rope lights. Although useful in the manufacture of incandescent based decorative lighting, the present invention is designed primarily for use with holiday and decorative lighting using LEDs (light emitting diodes) as an illumination source. An optional intermediate or junction circuit is included for the manufacture of light string employing multiple series connections.

2. Description of Related Art

Plugs and cord connectors that are known in the art for use in the manufacture of decorative lighting products such as Christmas lights and rope lights provide an inexpensive and reliable manner in which to house and insulate conductor terminals compatible with a standard AC outlets, optional overload protection (fuses) and conductor wire contacts. They are not designed to accommodate control circuits such as rectification, current reduction, current limiting, voltage reduction, blinking or flashing circuitry. These circuits are added afterwards and are typically housed somewhere between the plug and cord connector, adding cost, reducing reliability, complicating the manufacturing process, and detracting from the appearance of the light string.

U.S. Pat. No. 6,972,528 describes a rectification scheme wherein a portion of the rectification circuitry may be combined with the front plug or the rear plug however, the structure of the plug or cord connector is not disclosed and appears to have been added as an afterthought. Moreover, the circuitry described in the prior art decreases LED life expectancy, maximizes electrical power consumption and increases the number of wires required in the manufacture of the decorative light string as series connections are added.

SUMMARY OF THE INVENTION

It is an object of this invention to provide an improved plug, and plug and cord connector pair capable of addressing one or more of the above mentioned drawbacks.

It is another object of this invention to provide a standard, household plug and/or plug and cord connector pair to be used in the manufacture of decorative lighting products, particularly LED-based decorative lighting products that has integrated circuitry capable of reducing LED current.

It is another object of this invention to provide a standard, household plug and/or plug and cord connector pair to be used in the manufacture of decorative lighting products, particularly LED-based decorative lighting products that has integrated circuitry cable of limiting LED current.

It is another object of this invention to provide a standard, household plug and/or plug and cord connector pair to be used in the manufacture of decorative lighting products, particularly LED-based decorative lighting products that has integrated circuitry cable of full wave AC to DC rectification It is another object of this invention to provide a standard, household plug and/or plug and cord connector pair to be used in the manufacture of decorative lighting products, particularly LED-based decorative lighting products that eliminates the need for additional conductor wires in a rectified light string with multiple series connections.

It is another object of this invention to provide a standard, household plug and/or plug and cord connector pair to be used in the manufacture of decorative lighting products, particularly LED-based lighting products that minimizes electricity consumption while maximizing LED luminous intensity.

It is another object of this invention to provide a standard, household plug and/or plug and cord connector pair to be used in the manufacture of decorative lighting products, particularly LED-based decorative lighting products that has integrated circuitry cable of reducing voltage.

It is another object of this invention to provide a standard, household plug and/or plug and cord connector pair to be used in the manufacture of decorative lighting products, particularly LED-based decorative lighting products that has integrated circuitry cable of flashing.

It is another object of this invention to provide a standard, household plug and/or plug and cord connector pair to be used in the manufacture of decorative lighting products, particularly LED-based decorative lighting products that has integrated circuitry capable of any combination of the above.

It is another object of this invention to provide an intermediate, or junction circuit to be used in conjunction with the plug and cord connector pair described above in the manufacture of light strings employing multiple series connections.

Now the structure and features of this invention will be described in more detail with reference to the accompanying drawings.

BRIEF DESCRIPTION OF ACCOMPANYING DRAWINGS

FIG. 3A-3D is pictorial examples of integrated plug and cord connector circuits according to an embodiment of the invention.

FIG. 5A-5E is further pictorial examples of integrated plug and cord connector circuits according to another embodiment of the invention.

DETAILED DESCRIPTION OF THE PREFERRED EMBODIMENTS

Figure 1:
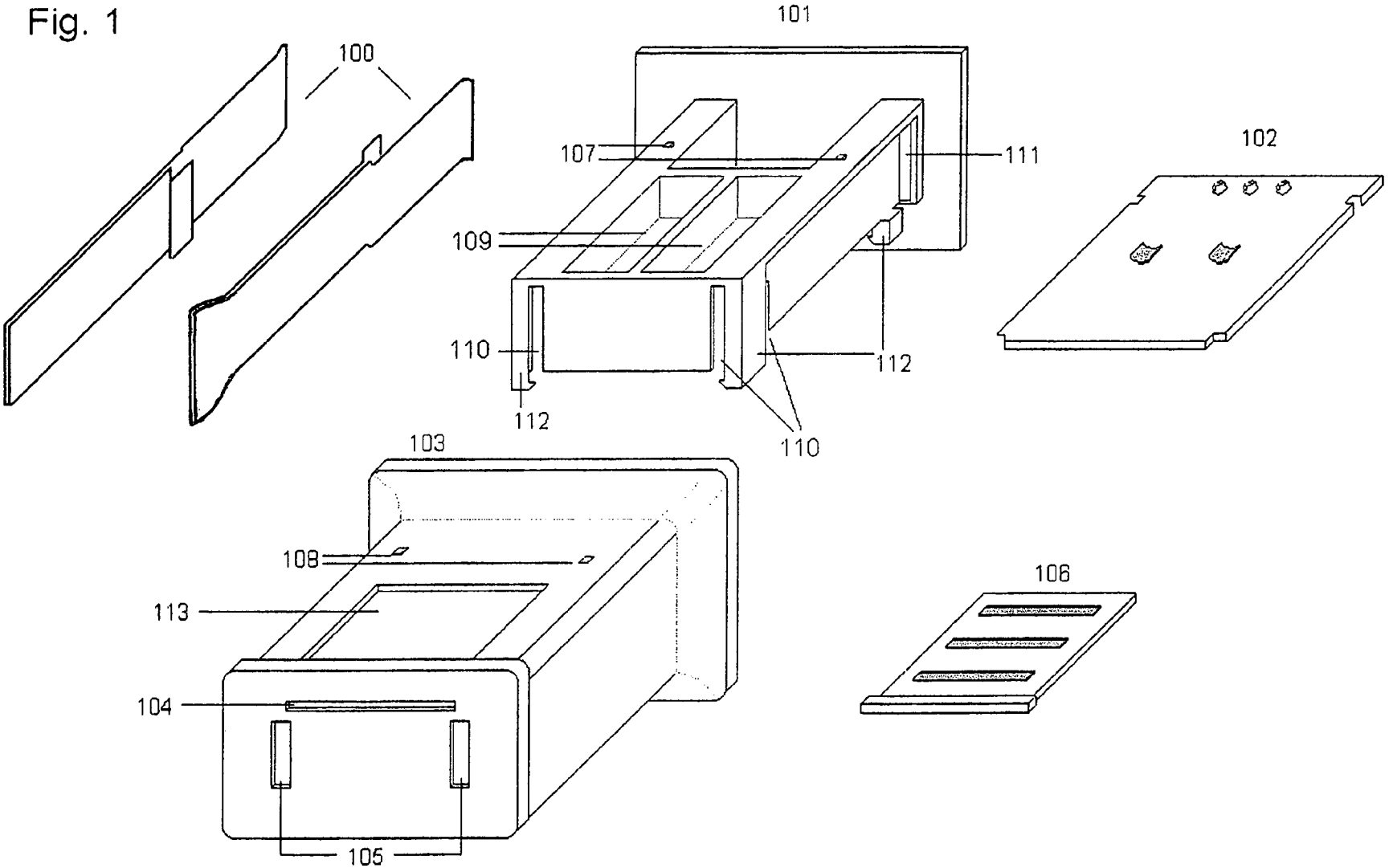
FIG. 1 is a pictorial example of the AC plug components according to an embodiment of the invention.

As shown in FIG. 1, the plug portion of the invention includes a pair of conductor blades (100), inner component housing (101) printed circuit board (102), protective outer shell (103) and sliding fuse cover (106).

Conductor blades (100) interface with a common household AC outlet as well as provide inbound AC electricity to the overload protection (safety fuses) and subsequent plugs connected in a "stacked" method. Conductor blades (100) are typically manufactured of copper or copper alloy. Conductor blades (100) secure symmetrically to inner component housing (101) via slots (110). In addition, conductor blades (100) can be the polarized (different blade width) or non-polarized (equal blade width) type.

Inner component housing (101) would typically be manufactured of impact resistant plastic with a high resistance to flammability and ultraviolet radiation and includes fuse compartments and separators (109), locking tabs (107), slots (111), and circuit board tabs (112).

Fuse compartment and separators (109) serve to house optional overload protection devices (fuses) and separate them against accidental short circuit.

Locking tabs (107) provide positive one-way locking of the fully assembled inner component housing (101) inside protective outer shell (103), making separation extremely difficult if not impossible.

Circuit board tabs (112) secure printed circuit board (102) to inner component housing (101). Tabs (112) are illustrated as an example only as there are many methods (such as slots or screws) to secure circuit board (102) to inner component housing (101).

Slots (111) provide an insulated opening in the inner component housing (101) to receive the conductor blades of subsequent plugs connected in a "stacked" manner.

Circuit board (102) houses the electrical components that become integrated in the plug portion of the invention. Circuit board (102) draws inbound AC power directly from conductor blades (100) or through an optional overload protection device (fuse, not shown). The inbound AC voltage is then conditioned, modified, or altered by the electrical components mounted in or on circuit board (102) and provides altered AC or DC power to the attached conductor wires.

Circuit board (102) can be configured to accommodate through-hole or surface mount electronic components and microelectronic circuits. In addition, it can be manufactured to mount, or house the electrical components on one side (single sided) or both (double sided).

Circuit board (102) can be configured to function as a "stand alone" unit, or be used in conjunction with a paired cord connector and/or intermediate circuit provided by the invention to complete the power conditioning or altering function of the invention. Additionally, it can optionally be sealed using commercially available sealants or potting compounds (after installation of the electrical components) to protect the electronic circuitry.

Numerous examples of circuit configurations are provided in the text and figures of the invention. They are not meant to be exhaustive, rather they are meant to serve as meaningful examples to one of ordinary skill in the art as to the usefulness, function and potential of the invention.

Protective outer shell (103) houses, insulates and protects inner component housing (101) including circuit board (102) and the rear portion of conductor blades (100). Protective outer shell (103) would typically be manufactured of impact resistant plastic with a high resistance to flammability and UV radiation.

Once conductor blades (100) and circuit board (102) are affixed to inner component housing (101) and the decorative light string conductor wires are attached, the entire assembly slides into the rear (open, not shown) opening of protective outer shell (103). Conductor blades (100) protrude through slots (105) and the entire assembly is pressed together until locking tabs (107) seat, or "click" into locking slots (108) making it very difficult, if not impossible to disassemble.

Protective fuses (not shown) are then installed via fuse access opening (113) completing the electrical contact between conductor blades (100) and circuit board (102). The electrical contact between the fuses and circuit board (102) can be a simple conductor pad mounted to the circuit board, or a metal fuse holder as shown in the various, included illustrations.

Sliding fuse cover (106) is then installed through slot (104) sealing fuse access opening (113). In the event a failed fuse requires changing, the decorative light set would need to be unplugged form the household outlet in order to slide fuse cover (106) forward, towards conductor blades (100), exposing fuse access opening (113) and fuse cavities (109).

It should be noted that although the "stackable", 3 Amp plug common to North America is illustrated, the preferred embodiments and teachings of the invention are equally applicable to the 5 Amp, non-stackable plug used in North America as well as the molded plugs used in Japan and larger plugs common to Europe.

Figure 1A:
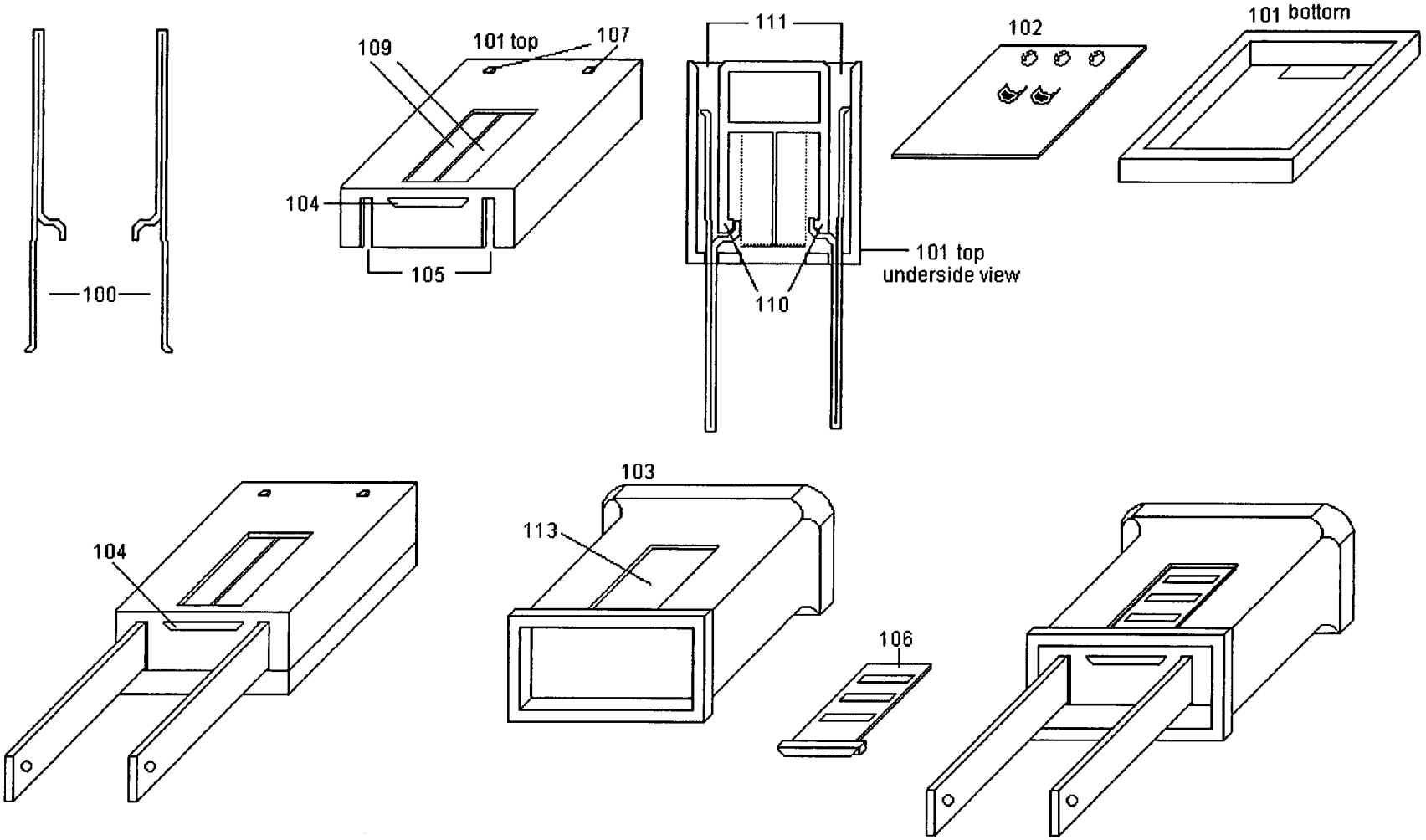
FIG. 1A is an alternate pictorial example of the AC plug components according to an embodiment of the invention.

FIG. 1A depicts an alternate to the plug configuration of FIG. 1 where inner component housing 101 is comprised of top and bottom portions designed to better protect circuit board 102. The fundamental construction is nearly identical to that disclosed in FIG. 1.

Figure 2:
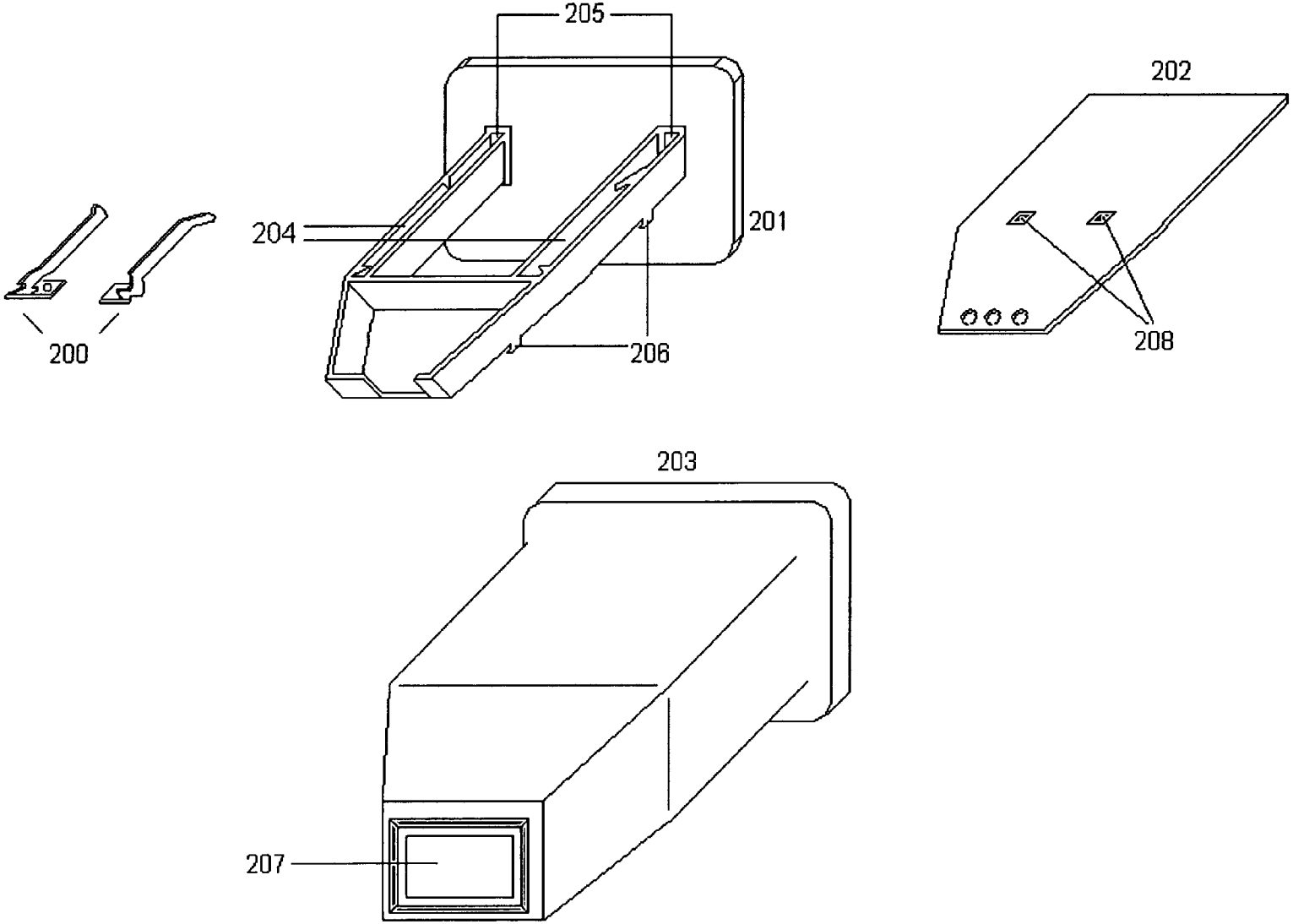
FIG. 2 is a pictorial example of the AC cord connector components according to an embodiment of the invention.

As shown in FIG. 2 the cord connector portion of the invention is similar to the plug shown in FIG. 1, consisting of a pair of conductor blades (200), an inner component housing (201), a printed circuit board (202) and a protective outer shell (203). The assembled inner housing (201) with conductor blades (200) and circuit board (202) sliding into the rear opening of protective outer shell (203), then "click" locking into place in a manner similar to the plug portion of the invention.

Conductor blades (200) are mounted in housing slots (204), contact electrode pads (208), thus becoming energized with AC voltage and acting as receptacle contacts for subsequent decorative lighting products. Conductor blades (200) would typically be manufactured using copper or copper alloy metal.

Inner component housing (201) accepts conductor blades (200) and secures circuit board (202) via clips (206). Slots (105) accept the conductor blades of subsequent decorative lighting products connected in an end-to-end manner. Inner component housing (201) would typically be manufactured of impact resistant plastic with high resistance to flammability and UV radiation.

Circuit board (202) houses the electrical components that become integrated in the cord connector portion of the invention. Circuit board (202) draws inbound AC power directly from the parallel conductor wires of the decorative lighting device, provides unaltered AC power to conductor blades (200) and operates in conjunction with the plug and/or junction portion of the invention to provide conditioned, modified, or altered AC or DC power to the series connected LED lamps of the decorative lighting device.

Circuit board (202) can be configured to accommodate through-hole or surface mount electronic components and microelectronic circuits. In addition, it can be manufactured to mount, or house the electrical components on one side (single sided) or both (double sided). Additionally, it can optionally be sealed using commercially available sealants or potting compounds (after installation of the electrical components) to protect the electronic circuitry.

Numerous examples of circuit configurations are provided in the text and figures of the invention. They are not meant to be exhaustive, rather they are meant to serve as meaningful examples to one of ordinary skill in the art as to the usefulness and potential of the invention.

Protective outer shell (203) houses, insulates and protects inner component housing (201) including circuit board (202) and conductor blades (200). Protective outer shell (203) would typically be manufactured of impact resistant plastic with a high resistance to flammability and UV radiation.

Once conductor blades (200) and circuit board (202) are affixed to inner component housing (201) and the decorative light string conductor wires are passes through wire opening (207) and attached to circuit board (202), the entire assembly slides into the rear (open, not shown) portion of protective outer shell (203). The entire assembly is pressed together until locking tabs (not shown) molded onto inner component housing (201) seat, or "click" into the corresponding locking slots (not shown) contained on protective outer shell (203), making it very difficult, if not impossible to disassemble.

Similar to the plug portion of the invention, the 3 Amp cord connector common to North America is illustrated. The preferred embodiments and teachings of the invention are equally applicable to other cord connectors in common use worldwide and can be easily manufactured by modifying the disclosed components.

FIG. 3A illustrates a simple form of the invention using an AC drive circuit and current reduction.

3A shows a top view of plug circuit board (102) shown in FIG. 1.

3B shows a bottom view of plug circuit board (102) shown in FIG. 1.

3C shows a top view of end connector circuit board (202, FIG. 2).

3D shows a bottom view of end connector circuit board (202, FIG. 2).

Marked as 301 are parallel conductor wire connections.

Marked as 302 are series conductor wire connections.

Marked as 303 are fuse holders as previously described.

Marked as 304 are end connector blade contact pads as previously described.

The example integrated circuits include 2 series resistors (R1 and R2) on FIG. 3B (plug PCB), 2 series resistors on FIG. 3D (cord connector PCB), plus an optional protective diode in 3B to protect the LEDs against reverse current leakage. A fewer (including none) or greater number of resistors can be used depending on the total circuit resistance required.

It should be noted that a varistor, capacitor, current saturated transistor, current limiting diode (CLD) or other impedance device can be substituted for one or more of the resistors shown. The tracers shown on PCB 3A and 3D complete the circuit therefore they are intended to be used as a matched pair on a simple, AC driven decorative light string where the LEDs are connected in series and an end connector and series resistance is desired.

The example circuits shown in FIG. 4 include current reduction, full wave circuit rectification when used as matched pairs, and reduced DC output ripple.

4A is a top view of plug circuit board (102, FIG. 1).

4B, 4E, and 4G are bottom views of plug of circuit board (102, FIG. 1).

4C is a top view of end connector circuit board (202, FIG. 2).

4D, 4F, and 4H are bottom views of end connector circuit board (202, FIG. 2).

Marked as 401 are parallel conductor wire connections.

Marked as 402 are series conductor wire connections.

Marked as 403 are fuse holders as previously described.

Marked as 404 are end connector blade contact pads as previously described.

Figures 4A, 4B, 4C, 4D, 4E, 4F, 4G, 4H:
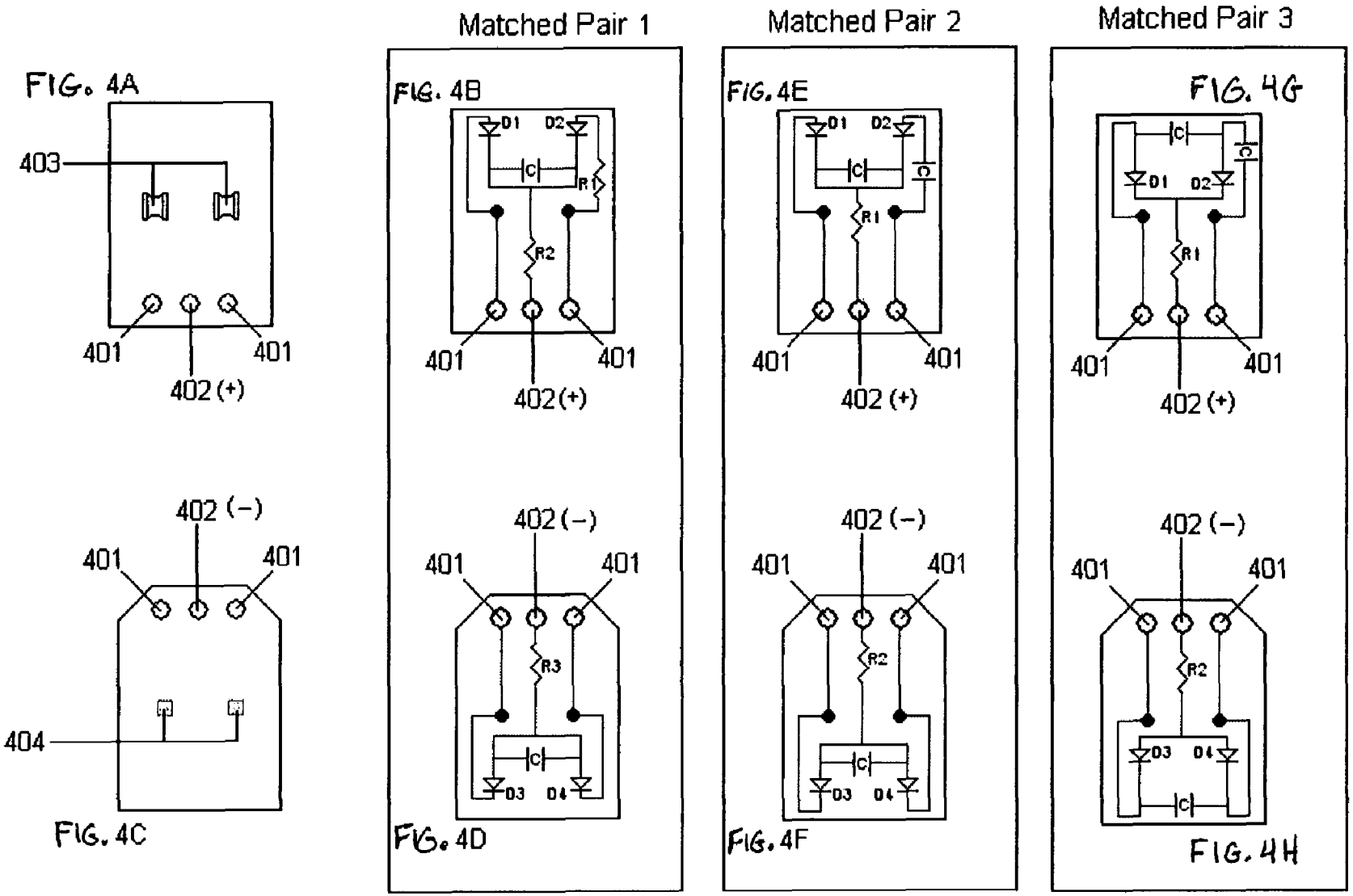
FIG. 4A-4H is further pictorial examples of integrated plug and cord connector circuits according to another embodiment of the invention.
Figures 6A, 6B, 6C, 6D, 6E:
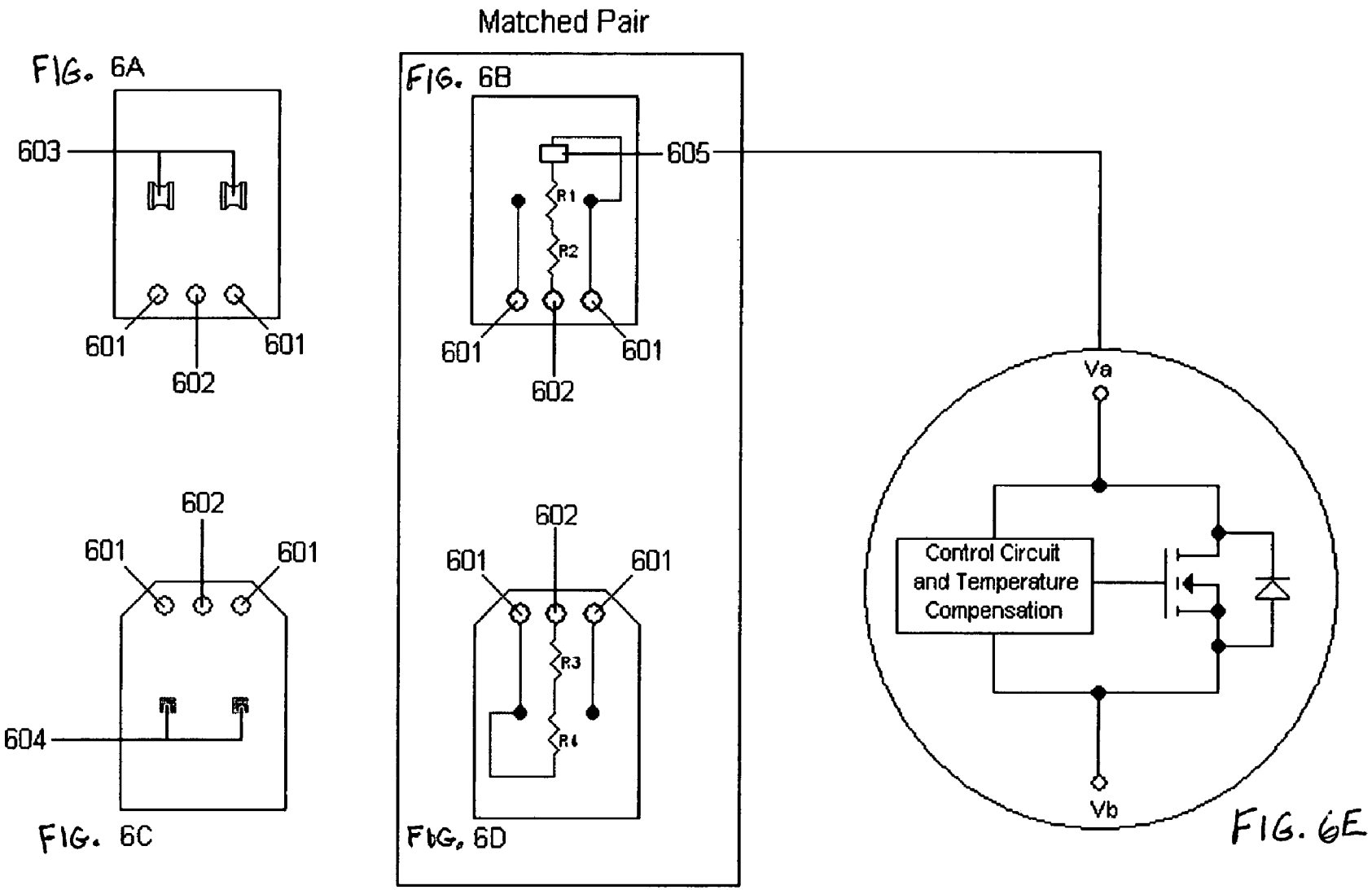
FIG. 6A-6E is further pictorial examples of integrated plug and cord connector circuits according to another embodiment of the invention.

With reference to FIGS. 4B & 4DH, Matched Pair 1 begins with plug circuit 4B, wherein a pair of rectifying diodes (D1 and D2) AC input voltage is reduced by resistor (R1), thus reducing the DC output voltage. A capacitor is connected in parallel across the DC terminals of rectifying diodes, D1 and D2 in order to smooth DC ripples. Optional series resistor R2 terminates in series conductor 402. End connector circuit 4D reverses the order of the components. Optional series resistor R3 receives series conductor 402, then rectifying diodes D3 and D4 return to parallel conductors 401, thus completing the circuit. A capacitor is connected in parallel across the DC terminals of diodes D3 and D4 to further smooth DC ripple. Although not critical to the function of the circuit, the parallel capacitors are added to smooth DC ripples, highly desirable to maximize LED longevity. A varistor, current saturated transistor, current limiting diode (CLD) or other impedance device can be substituted for one or more of resistors R2 and R3.

With reference to FIGS. 4E & 4F, Matched Pair 2 is the same circuit as described in FIG. 4B/4D, Matched Pair 1; however; rectifying diodes D1 and D2 utilize a reactive AC input element (capacitor) to reduce DC output. This adds design flexibility to the number of series connected LED lamps and reduces heating of the circuit. Once again, a varistor, current saturated transistor, current limiting diode (CLD) or other impedance device can be substituted for one or more of the optional resistors R1 and R2.

With reference to FIGS. 4G & 4H, Matched Pair 3 is also very similar to FIG. 4, Matched Pairs 1 and 2 however; a capacitor is connected in parallel across the AC terminals of both D1 and D2 on the plug side, and D3 and D4 on the cord connector side. This circuits also reduces AC input to rectifying diodes D1 and D2 utilizing a reactive element (capacitor) to reduce DC output. This example configuration has shown to be the most efficient in minimizing DC series ripple to nearly linear as well as reducing electrical consumption of the light string since DC series output can be matched to the total voltage drop of the series connected LEDs. Once again, a varistor, current saturated transistor, current limiting diode (CLD) or other impedance device can be substituted for one or more of the optional resistors R1 and R2.

The circuit shown in FIG. 5A-5D includes full wave rectification and a commercially available constant current LED driver IC. Input current applied to the LED lamps in series is limited (typically to 20 mA) and remains constant across a broad range of input voltage.

5A is a top view of plug circuit board (102, FIG. 1).

5B is a bottom view of plug of circuit board (102, FIG. 1).

5C is a top view of end connector circuit board (202, FIG. 2).

5D is a bottom view of end connector circuit board (202, FIG. 2).

Marked as 501 are parallel conductor wire connections.

Marked as 502 are series conductor wire connections.

Marked as 503 are fuse holders as previously described.

Marked as 504 are end connector blade contact pads as previously described.

Marked 505 is a commercially available, constant current LED driver IC shown in detail of FIG. 5E.

Matched Pair 5B plug and 5D cord connector include optional resistors R1 through R4. These are included as optional elements in order to lessen, or remove a fundamental restriction associated with constant current IC's. That is, in the circuit shown the constant current IC would typically have a maximum compensating voltage drop of 90 V. Optional resistors R1 through R4 or other impedance device can therefore be added as needed so as not to approach the IC maximum compensating voltage.

The example circuit shown in FIGS. 6A-6D uses the same constant current LED driver IC contained in FIG. 5A-5D however, the LED lamps are AC driven and therefore have some "off" time due to the negative portion of the AC sine wave. Like the circuit shown in FIGS. 5A-5D, input current applied to the LED lamps in series is limited (typically to 20 mA) and remains constant during the positive half of the AC cycle.

6A is a top view of plug circuit board (102, FIG. 1).

6B is a bottom view of plug of circuit board (102, FIG. 1).

6C is a top view of end connector circuit board (202, FIG. 2).

6D is a bottom view of end connector circuit board (202, FIG. 2).

Marked as 601 are parallel conductor wire connections.

Marked as 602 are series conductor wire connections.

Marked as 603 are fuse holders as previously described.

Marked as 604 are end connector blade contact pads as previously described.

Marked 605 is a commercially available, constant current LED driver IC

Matched Pair 6B plug and 6D cord connector include optional resistors R1 through R4. Another impedance device can be substituted.

The example circuits shown in FIG. 7A-7D are examples of plug (102) only circuits that can be used on decorative light strings that do not include a cord connector.

7A is a top and bottom view of plug circuit board (102, FIG. 1).

7B is a top and bottom view of an alternate plug circuit board (102, FIG. 1).

7C is a top and bottom view of an alternate plug circuit board (102, FIG. 1).

7D is a top and bottom view of an alternate plug circuit board (102, FIG. 1).

Marked as 702 are series conductor wire connections.

Marked as 703 are fuse holders as previously described.

Figure 7A:
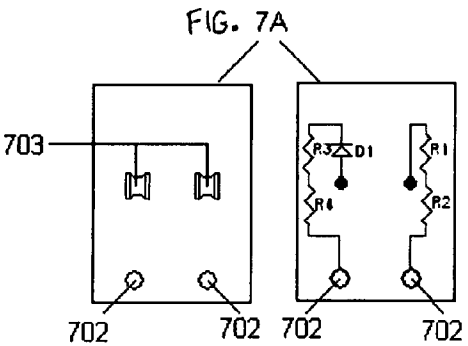
FIG. 7A-7F is pictorial examples of integrated plug only circuits according to another embodiment of the invention.
Figure 7B:
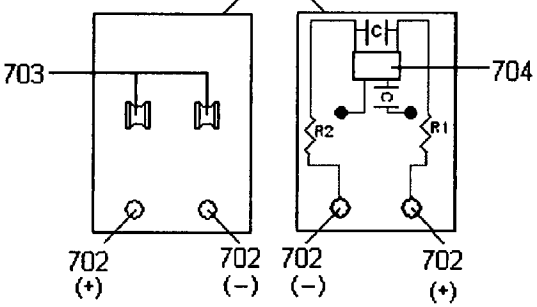
Figure 7C:
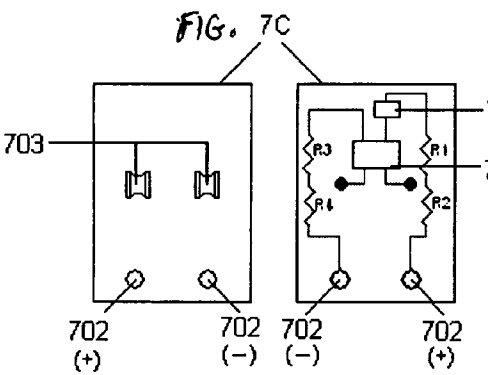
Figure 7D:
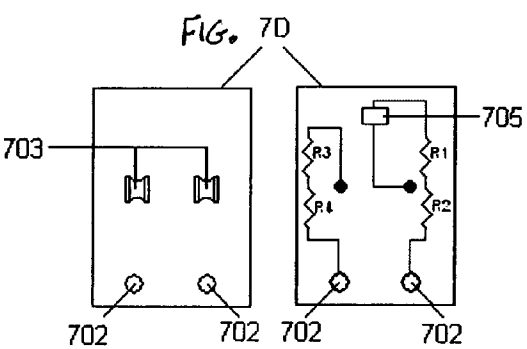
Figure 7E:
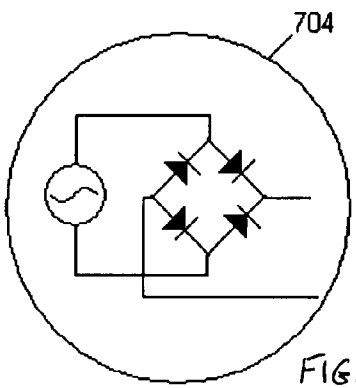

Marked as 704 is a commercially available full wave bridge rectifier shown in FIG. 7E.

Figure 7F:
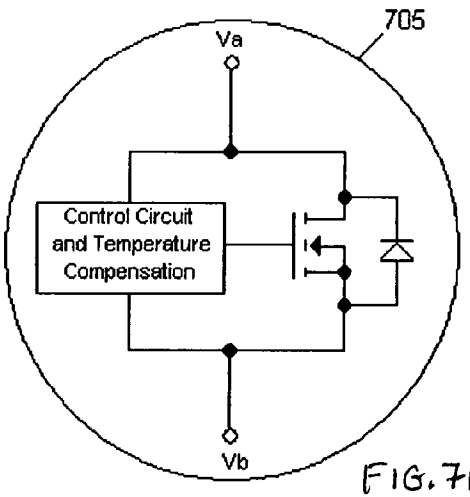

Marked as 705 is a commercially available, constant current LED driver IC shown in FIG. 7F.

FIG. 7A illustrates a simple, AC drive circuit similar to the one depicted in FIG. 3. This circuit includes optional series resistance, R1 through R4 and can also include an optional protective diode. A varistor, capacitor, current saturated transistor, current limiting diode (CLD) or other impedance device can be substituted for one or more of the resistors shown. This circuit provides basic LED current reduction.

FIG. 7B illustrates a rectified circuit much like those shown in FIG. 4. This circuit includes full wave rectification fed by an optional capacitor or resistor, an optional capacitor connected in parallel across the rectifier output (DC) terminals to smooth DC ripples, and optional resistors R1 and R2. A varistor, capacitor, current saturated transistor, current limiting diode (CLD) or other impedance device can be substituted for one or more of the resistors shown.

FIG. 7C illustrates a rectified, constant current circuit similar the one depicted in FIG. 5. This circuit includes a commercially available full wave rectifier of very compact size, a commercially available constant current LED driver IC, and optional resistors R1 through R4.

FIG. 7D illustrates an AC drive, constant current circuit similar to the one depicted in FIG. 6. This circuit includes a commercially available constant current LED driver IC and optional resistors R1 through R4.

The circuits shown in FIGS. 8A-8E are examples of the optional intermediate, or junction circuit portion of the invention and can be used in the manufacture of decorative light strings having multiple series connections. Using this optional aspect has shown to save manufacturing time as well as material since additional conductor wires is eliminated. In addition, a higher degree of circuit reliability is gained as individual series blocks of lamps operate independently, reducing the strain on electrical components included in the plug and cord connector portion of the circuit. The usefulness of this aspect of the invention will become apparent to one of ordinary skill in the art as they note the junction circuits function to complete the series and parallel connections formed by the plug circuits, then form new series and parallel connections to be completed by the cord connector portion of the invention.

Marked as 801 are parallel conductor wire connections.

Marked as 802 are series conductor wire connections.

Figures 8, 8A, 8B, 8C, 8D, 8E:
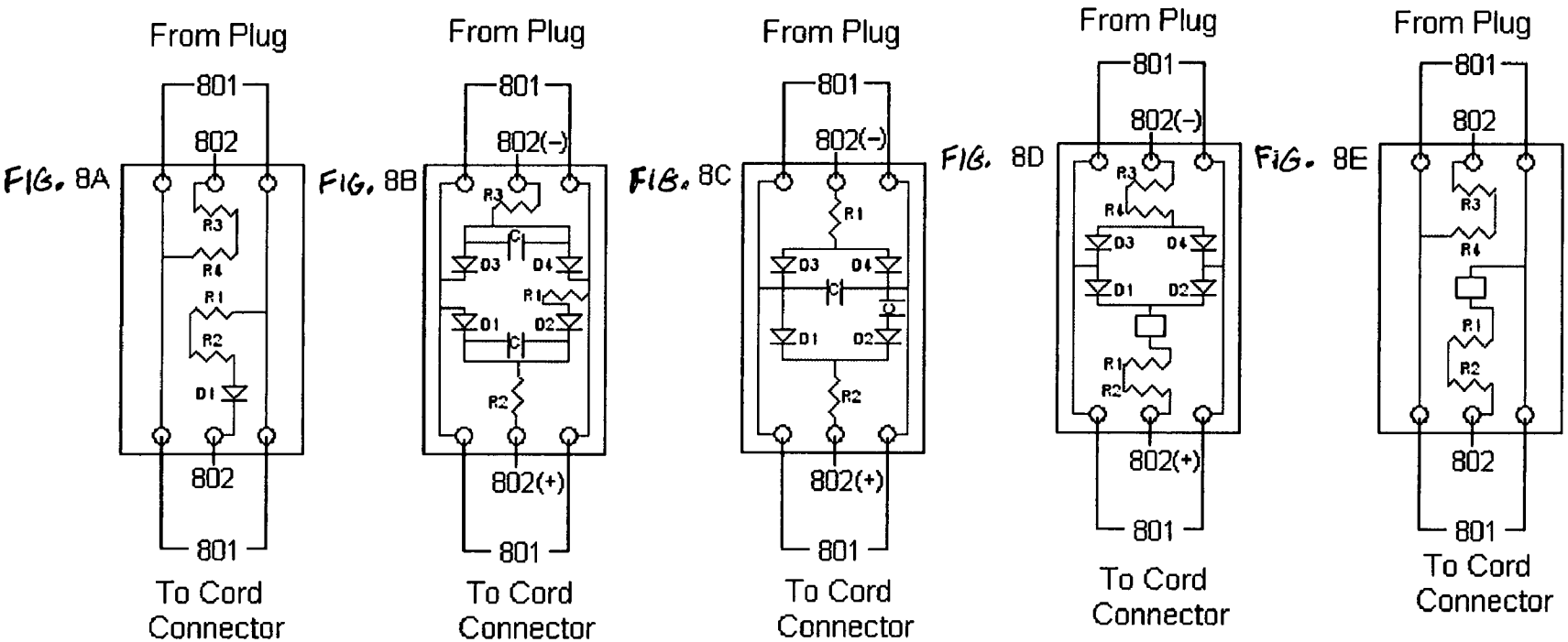
FIG. 8 is pictorial examples of optional intermediate, or junction circuits according to another embodiment of the invention.

FIG. 8A shows a simple, current reducing AC junction circuit that can be used with the matched plug and cord connector pair shown in FIG. 3.

FIG. 8B shows an example of a rectified, current reducing, and DC ripple filtering junction circuit to be used in conjunction with matched plug and cord connector pair 1 or 2 shown in FIG. 4.

FIG. 8C shows an alternate example of a rectified, current reducing and DC ripple filtering junction circuit to be used with the matched plug and cord connector pair 3 shown in FIG. 4

FIG. 8D shows an example of rectified, constant current (current limiting) junction circuit to be used with the matched plug and cord connector pair shown in FIG. 5.

FIG. 8E shows an example of a constant current (current limiting) AC junction circuit to be used with the matching plug and cord connector pair shown in FIG. 6.

The circuits shown in FIGS. 8A-8E can be protected by placing them in a small box manufactured of non-electrically conductive material that can be optionally potted or sealed using a commercially available potting or sealing compound making them suitable for use in damp locations. An alternate form of sealing could be jacketing them in plastic or other non conductive material using an insert molding process.

Figures 9A, 9B, 9C, 9D, 9E:
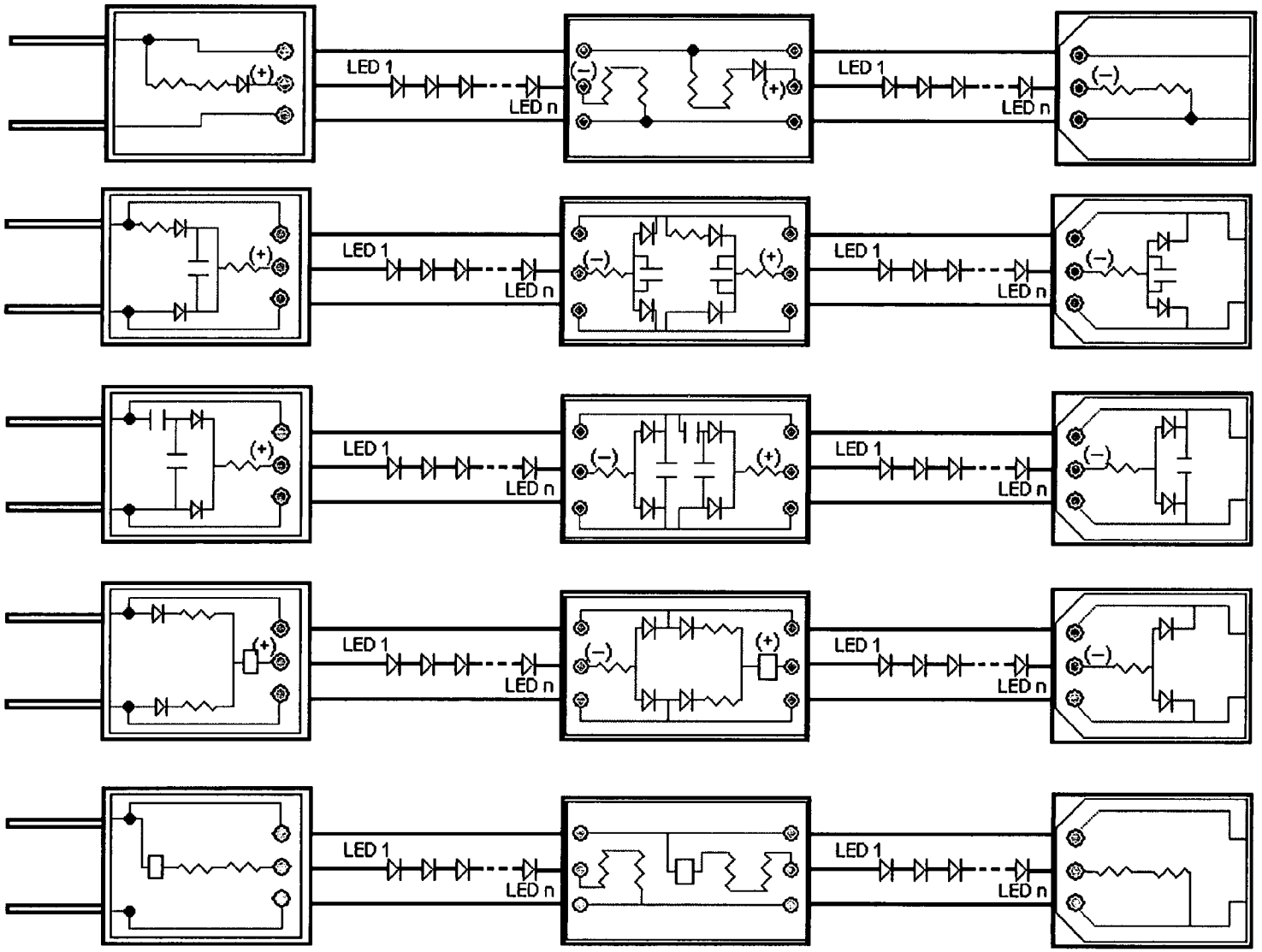
FIGS. 9A-9E are pictorial examples of functional decorative LED light configurations incorporating the plug, intermediate circuit, and cord connector embodiment of the invention.

FIG. 9 depicts functional circuit diagrams of decorative LED lights with multiple series connections using the plugs, junctions, and cord connector examples disclosed in the invention.

9A shows the matching plug and cord connector pair in FIG. 3 with junction circuit 8A.

9B shows the matching plug cord connector pair 1 (FIG. 4) with junction circuit 8B.

9C shows the matching plug and cord connector pair 3 (FIG. 4) with junction circuit 8C.

9D shows the matching plug and cord connector pair in FIG. 5 with junction circuit 8D.

9E shows the matching plug and cord connector pair in FIG. 6 with junction circuit 8E.

FIG. 10 depicts an example plug, junction, and cord connector circuit wherein a capacitor fed conventional rectification scheme is employed. A second, filtering capacitor is connected in parallel across the DC series terminals to reduce DC ripple.

Figure 10D:
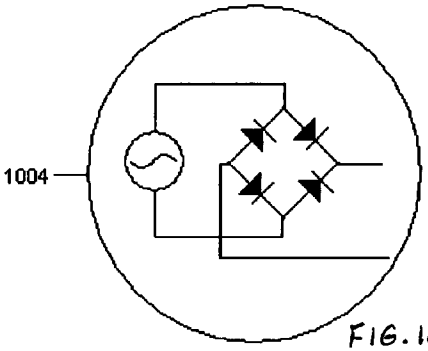
FIGS. 10A-10E are pictorial examples of additional integrated plug, intermediate, and cord connector circuitry and corresponding functional decorative LED light configuration according to an embodiment of the invention.
Figure 10C:
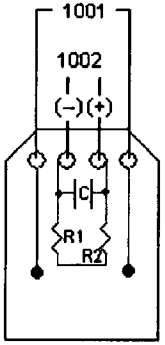
Figure 10B:
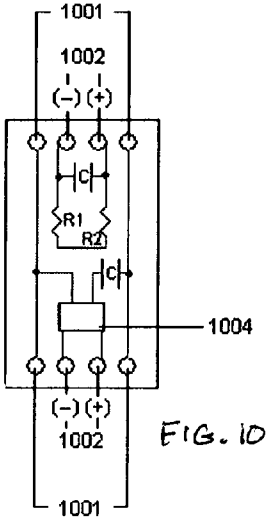
Figure 10A:
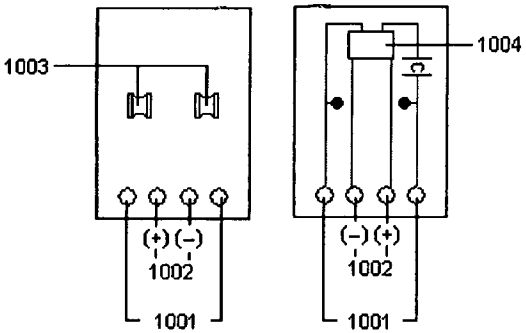

FIG. 10A is a top and bottom view of plug circuit board (102, FIG. 1).

FIG. 10B is the corresponding junction circuit configuration.

FIG. 10C is a bottom view of end connector circuit board (202, FIG. 2).

FIG. 10D illustrates the full wave bridge 1004.

Figure 10E:
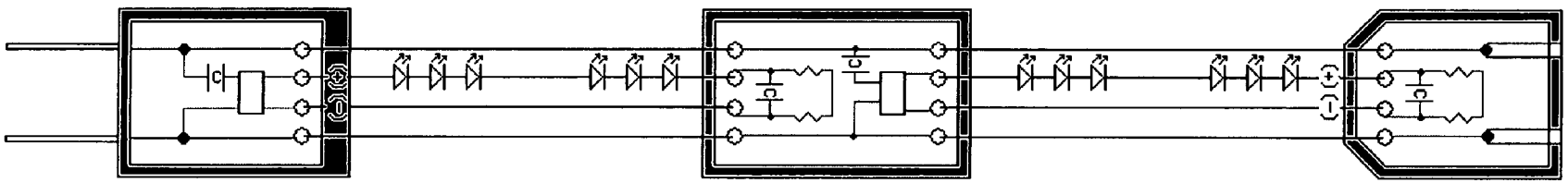

FIG. 10E is a functional circuit diagram of a decorative light string employing 10A, 10B, and 10C.

Marked 1001 are parallel conductor connections.

Marked 1002 are series conductor connections.

Marked as 1003 are fuse holders as previously described.

Marked 1004 is a full wave bridge. FIG. 10D is a functional circuit diagram of a decorative light string employing 10A, 10B, and 10C.

Figure 11C:
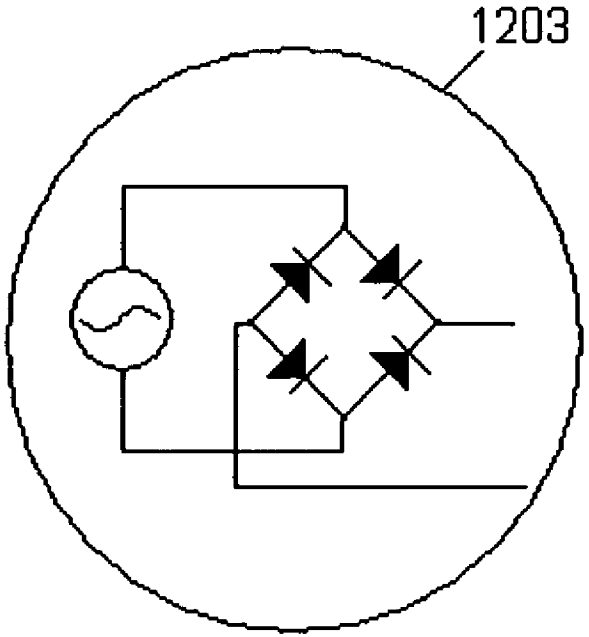
FIG. 11 is a pictorial example of a voltage reducing circuit according to another embodiment of the invention.

FIG. 11 illustrates an example of a voltage reducing circuit similar to those used in commercial battery chargers however; additional circuitry is added to stabilize output voltage. DC output voltage is tightly controlled in this type circuit; therefore it is well suited for use as an integrated plug circuit for decorative LED products where the LED lamps are connected in parallel. The resistor/capacitor ratio formulas required to arrive at the desired drive voltage are known in the art and are purposely omitted.

Figure 11B:
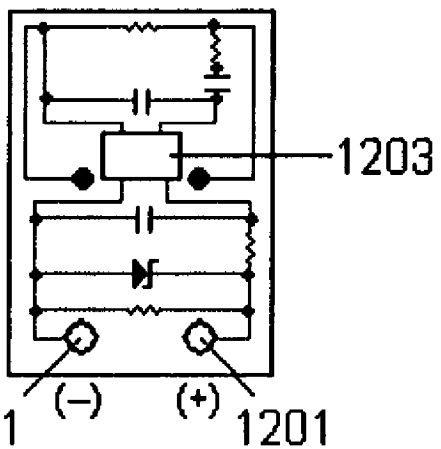
Figure 11A:
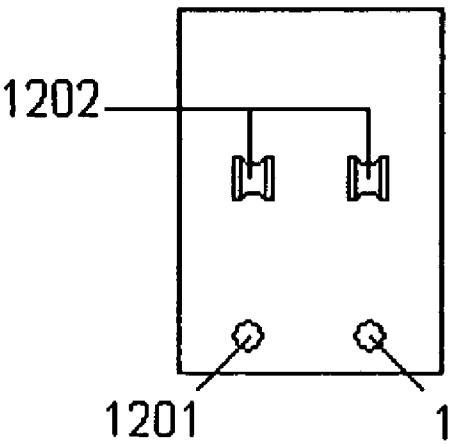

FIG. 11A is a top view of plug circuit board (102, FIG. 1).

FIG. 11B is a bottom view of plug circuit board (102, FIG. 1).

Marked as 1201 are parallel conductor wire connections.

Marked as 1202 are fuse holders as previously described.

Marked as 1202 in FIG. 1 IC is a commercially available full wave bridge rectifier.

It should be noted that flashing or blinking integrated circuits (IC's) can be added to any of the circuit examples illustrated. They are known in the art and are therefore specifically not shown.

The forgoing detailed description of the preferred embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in the art and are encompassed within the spirit and scope of the appended claims.

What is claimed is:

1. A combination of a connector assembly and an LED lighting chain, comprising:

an inner component housing;

a pair of conductor blades symmetrically secured to said inner component housing;

a circuit board housing electrical components of a current altering circuit, said circuit board being a modular unit that is mounted to said inner component housing;

a protective outer housing adapted to insulate and protect said inner component housing and said circuit board;

at least one LED serial set of a plurality of LEDs defining said LED lighting chain electrically connected to said conductor blades through conductor wires, wherein said current altering circuit defines a rectifier circuit.

2. The combination of claim 1, wherein said conductor blades are polarized such that the blades are different widths.

3. The combination of claim 1, wherein said circuit board is configured to accommodate through-hole or surface mount electronic components and microelectronic circuits.

4. The combination of claim 1, wherein said circuit board is sealed to protect the electrical components.

5. A combination of a connector assembly and an LED lighting chain, comprising:

an inner component housing;

a pair of conductor blades symmetrically secured to said inner component housing;

a circuit board housing electrical components of a current altering circuit, said circuit board being a modular unit that is mounted to said inner component housing;

a protective outer housing adapted to insulate and protect said inner component housing and said circuit board;

at least one LED serial set of a plurality of LEDs defining said LED lighting chain electrically connected to said conductor blades through conductor wires, further comprising a female receptacle adapted to received a second set of conductor blades to define a stackable plug connector.

6. A combination of a connector assembly and an LED lighting chain, comprising:

an inner component housing;

a pair of conductor blades symmetrically secured to said inner component housing;

a circuit board housing electrical components of a current altering circuit, said circuit board being a modular unit that is mounted to said inner component housing;

a protective outer housing adapted to insulate and protect said inner component housing and said circuit board;

at least one LED serial set of a plurality of LEDs defining said LED lighting chain electrically connected to said conductor blades through conductor wires, wherein said circuit board draws inbound electrical alternating current from said conductor blades through an overload protection device.

7. A combination of a connector assembly and an LED lighting chain, comprising:

an inner component housing;

a pair of conductor blades symmetrically secured to said inner component housing;

a circuit board housing electrical components of a current altering circuit, said circuit board being a modular unit that is mounted to said inner component housing;

a protective outer housing adapted to insulate and protect said inner component housing and said circuit board;

at least one LED serial set of a plurality of LEDs defining said LED lighting chain electrically connected to said conductor blades through conductor wires, wherein said inner component housing comprises at least one fuse compartment for receiving at least one fuse adapted to electrically connect said conductor blade with said wires.

8. A combination of a connector assembly and an LED lighting chain, comprising:

an inner component housing;

a pair of conductor blades symmetrically secured to said inner component housing;

a circuit board housing electrical components of a current altering circuit, said circuit board being a modular unit that is mounted to said inner component housing;

a protective outer housing adapted to insulate and protect said inner component housing and said circuit board;

at least one LED serial set of a plurality of LEDs defining said LED lighting chain electrically connected to said conductor blades through conductor wires, wherein said inner component housing comprises at least one locking tab for locking said inner compartment housing to said outer housing.

9. A combination of a connector assembly and an LED lighting chain, comprising:

an inner component housing;

a pair of conductor blades symmetrically secured to said inner component housing;

a circuit board housing electrical components of a current altering circuit, said circuit board being a modular unit that is mounted to said inner component housing;

a protective outer housing adapted to insulate and protect said inner component housing and said circuit board;

at least one LED serial set of a plurality of LEDs defining said LED lighting chain electrically connected to said conductor blades through conductor wires, wherein the inner component housing and said circuit board as a modular assembly are affixed to said outer housing by a snap-fit connection.

10. A combination of a connector assembly and an LED lighting chain, comprising:

an inner component housing;

a pair of conductor blades symmetrically secured to said inner component housing;

a circuit board housing electrical components of a current altering circuit, said circuit board being a modular unit that is mounted to said inner component housing;

a protective outer housing adapted to insulate and protect said inner component housing and said circuit board;

at least one LED serial set of a plurality of LEDs defining said LED lighting chain electrically connected to said conductor blades through conductor wires, wherein said inner component housing comprises slots for mounting the conductor blades.

11. A combination of a connector assembly and an LED lighting chain, comprising:

an inner component housing;

a pair of conductor blades symmetrically secured to said inner component housing;

a circuit board housing electrical components of a current altering circuit, said circuit board being a modular unit that is mounted to said inner component housing;

a protective outer housing adapted to insulate and protect said inner component housing and said circuit board;

at least one LED serial set of a plurality of LEDs defining said LED lighting chain electrically connected to said conductor blades through conductor wires, wherein said circuit board houses a plurality of series resistors, conductor wires connections and connector blade contact pads.

12. A combination of a connector assembly and an LED lighting chain, comprising:

an inner component housing;

a pair of conductor blades symmetrically secured to said inner component housing;

a circuit board housing electrical components of a current altering circuit, said circuit board being a modular unit that is mounted to said inner component housing;

a protective outer housing adapted to insulate and protect said inner component housing and said circuit board;

at least one LED serial set of a plurality of LEDs defining said LED lighting chain electrically connected to said conductor blades through conductor wires, wherein said circuit board houses rectifying diodes and at least one of a resistor and capacitor.

13. The combination of claim 12, wherein said circuit board houses a capacitor connected in parallel across DC terminals of said rectifying diodes in order to smooth DC ripples.

* * * * *